US005172990A

United States Patent [19]

Weng

[11] Patent Number: 5,172,990

[45] Date of Patent: Dec. 22, 1992

[54] STRUCTURES OF PUSH - BUTTON KEY OF KEYBOARD

[75] Inventor: Phil Weng, Taipei, Taiwan

[73] Assignee: Cal-Comp Electronics, Inc., Taipei, Taiwan

[21] Appl. No.: 704,954

[22] Filed: May 23, 1991

[51] Int. Cl.[5] ..... B41J 5/12; H01H 3/12; H01H 13/70

[52] U.S. Cl. ..... 400/490; 400/493.1; 400/494; 400/495; 200/341; 200/345

[58] Field of Search ..... 400/490, 493.1, 494, 400/495; 200/5 A, 341, 345

[56] References Cited

U.S. PATENT DOCUMENTS

| | | | |
|---|---|---|---|
| 4,556,769 | 12/1985 | Inaba | 200/345 |
| 4,656,078 | 4/1987 | Goto et al. | 400/490 |
| 4,827,243 | 5/1989 | Cheng | 200/345 |
| 4,918,271 | 4/1990 | Deeg | 200/345 |

FOREIGN PATENT DOCUMENTS

| | | | |
|---|---|---|---|
| 2124156 | 2/1984 | United Kingdom | 400/490 |

OTHER PUBLICATIONS

IBM Technical Disclosure Bulletin, pp. 408–411, vol. 30, No. 1, Jun. 1987.

*Primary Examiner*—Edgar S. Burr

*Assistant Examiner*—Lynn D. Hendrickson

*Attorney, Agent, or Firm*—Fleit, Jacobson, Cohn, Price, Holman & Stern

[57] ABSTRACT

The improved structures of the push-button key of keyboard are characterized in that the upper housing panel of keyboard comprises a plurality of partitioned sections where the push-button keys are installed, and that a key barrel of a predetermined height is set up at the center of each of the partitioned sections. The barrel wall comprises two slide keys positioned correspondingly to two slide key seats of the push-button key. The hooking means are arranged in the partitioned section at a predetermined distance from the key barrel. The stability of up-and-down movement of the push-button key is ensured by virtue of a coordinated action of slide key and slide key seats. The hooking means serve to confine the movement of the push-button key and to prevent the push-button key from being detached easily. The push-button key is further improved structurally in such manners that the face plate and the bottom portion of the key are of different colors and that the face plate comprises holes of various shapes conforming to the shapes of the designated letters or the Arabic numerals. Therefore, the letters, words, or Arabic numerals appeared on the surfaces of the keys do not become obscure after a prolonged usage thereof.

6 Claims, 3 Drawing Sheets

FIG. 3A
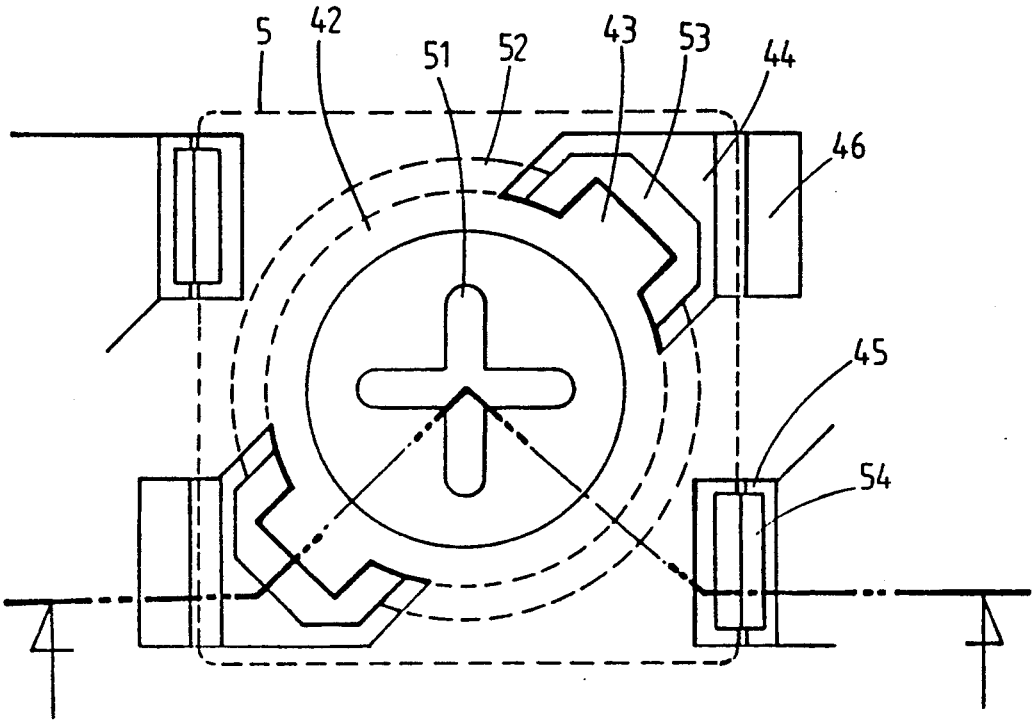
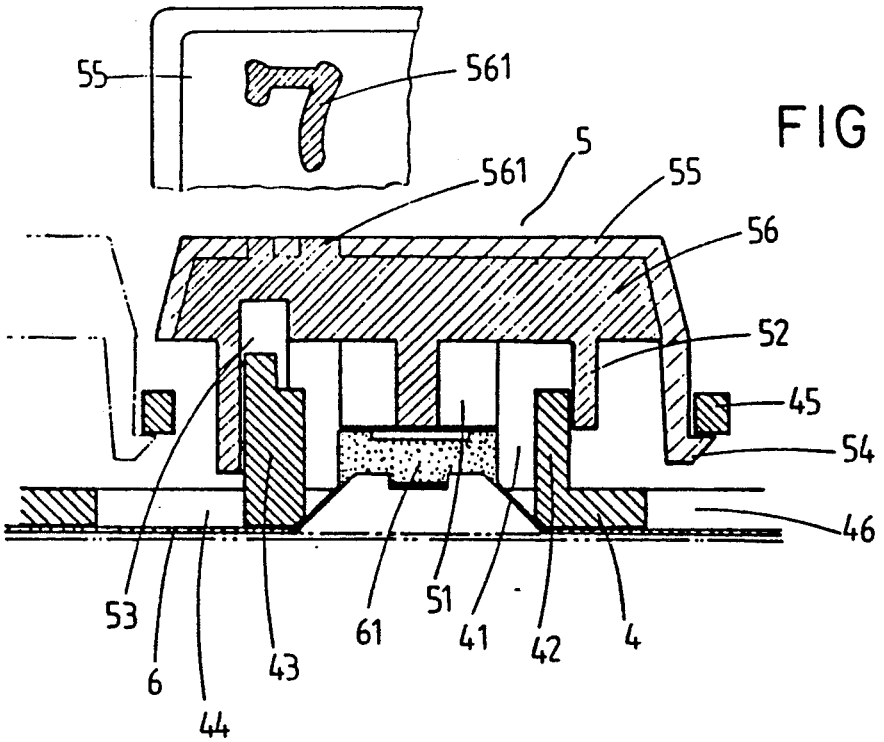
FIG. 3B

STRUCTURES OF PUSH - BUTTON KEY OF KEYBOARD

BACKGROUND OF THE INVENTION

The present invention relates to the improved structures of the push-button keys of the keyboard, which are characterized in that the coupling of the push-button keys and the upper housing panel is strengthened, and that the push-button keys can be pressed precisely without deviation, and further that letters, words, or Arabic numerals appeared on the surfaces of the push-button keys are disposed in such a manner that they do not become obscure after a prolonged usage thereof.

Referring to FIG. 1, the structure of the conventional keyboard keys of prior art is shown comprising an upper housing panel 1 with circular hole 11 arranged thereon. The circular hole 11 comprises two fastening hooks 12 arranged oppositely on the inner circumference thereof. A rubber elastic membrance 2 is disposed in the circular hole 11. A push-button key 3 comprises two hooking lugs 31 arranged oppositely on the undersides thereof. Located at the center of the underside of the push-button key 3 is a press column 32. In the process of assembling the push-button key 3 of keyboard, two hooking lugs 31 are allowed to engage with two fastening hooks 12 of the upper housing panel 1. The press column 32 is permitted to attach to the top portion of the rubber elastic membrance 2. The engagement of the two hooking lugs 31 and the two fastening hooks 12 is arranged in such a manner that there is a sufficient room for them to slide upwardly and downwardly. However, a secure coupling of the push-button key 3 and the upper housing panel 1 is always compromised by the fact that both hooking lugs 31 and fastening hooks 12 are not thick enough to sustain effectively the constant pressure exerting thereon. The thickness of both hooking lugs 31 and fastening hooks 12 must be limited because of the facts that there is a very little spare room located on both sides of the center line of the push-button key and that both hooking lugs 31 and fastening hooks 12 must be spaced apart from the inflated portion 21 of the rubber elastic membrane 2. The constructional design of the push-button key 3 is defective in that the push-button key 3 tends to move aside and inaccurately when pressed. As a result, the pressed push-button key 3 fails to exert a pressure directly on the upper portion of the rubber elastic membrance 2, thereby resulting in a poor contact which in turn may bring about a failure of data entry. In addition, both hooking lugs 31 and fastening hooks 12 are so constructed that they are susceptible to breakage when the push-button key 3 is pressed forcefully.

SUMMARY OF THE INVENTION

It is, therefore, the primary objective of the present invention to provide a push-button key, which is fastened securely with the upper housing panel and is capable of being pressed down accurately and faithfully.

It is another objective of the present invention to provide a push-button key, whose letter, word, or character impressed thereon does not become obscure after a prolonged usage of the key.

In keeping with the principles of the present invention, the primary objectives of the present invention are accomplished by the improved push-button key which is characterized in that the upper housing panel of keyboard comprises a plurality of partitioned sections where the push-button keys are installed, and that a key barrel of a predetermined height is set up at the center of each of the partitioned sections. The barrel wall comprises two slide keys positioned correspondingly to two slide key seats of the push-button key. In addition, hooking means are arranged in the partitioned section at a predetermined distance from the key barrel. The stability of up-and-down movement of the push-button key is ensured by virtue of a coordinated action of slide key and slide key seat. The hooking means serve to confine the movement of the push-button key and to prevent the push-button key from being detached easily. The push-button key is further improved structurally in such manners that the face plate and the bottom portion of the key are of different colors and that the face plate comprises holes of various shapes conforming to the shapes of the designated letters or the Arabic numerals. Therefore, the letters, words, or Arabic numerals appeared on the surfaces of the keys do not become obscure after a prolonged usage thereof.

BRIEF DESCRIPTION OF THE DRAWINGS

FIGS. 3*a* and 3*b* shows sectional views of structures as shown in FIG. 2.

DETAILED DESCRIPTION OF THE PREFERRED EMBODIMENTS

Figure 2:
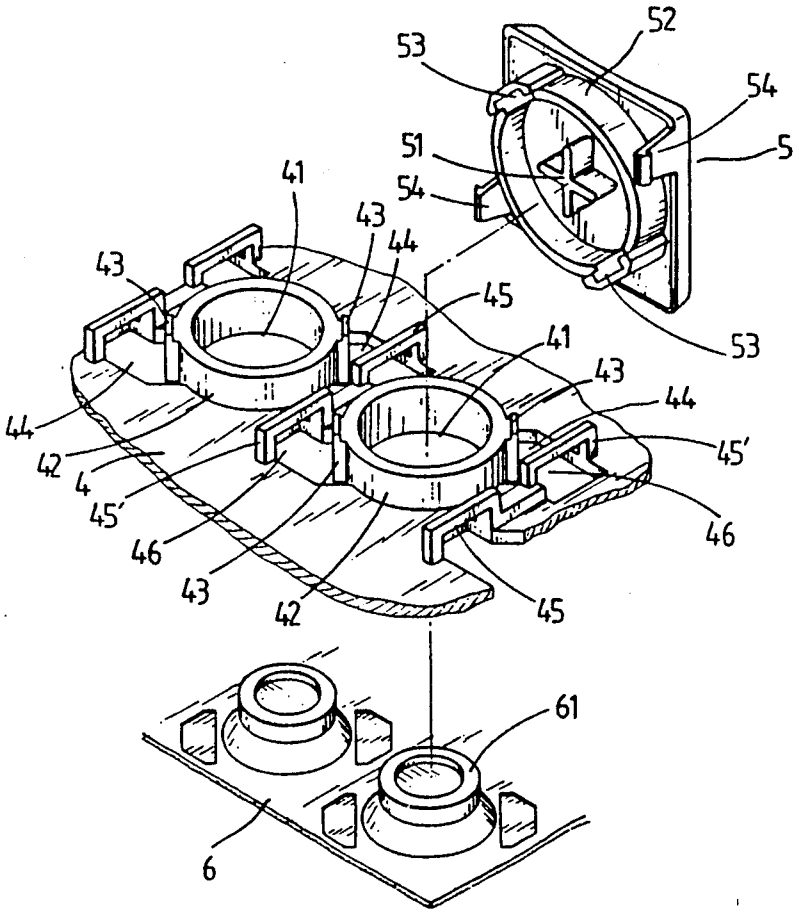
FIG. 2 shows an exploded view of the preferred embodiment of the present invention.
Figure 1:
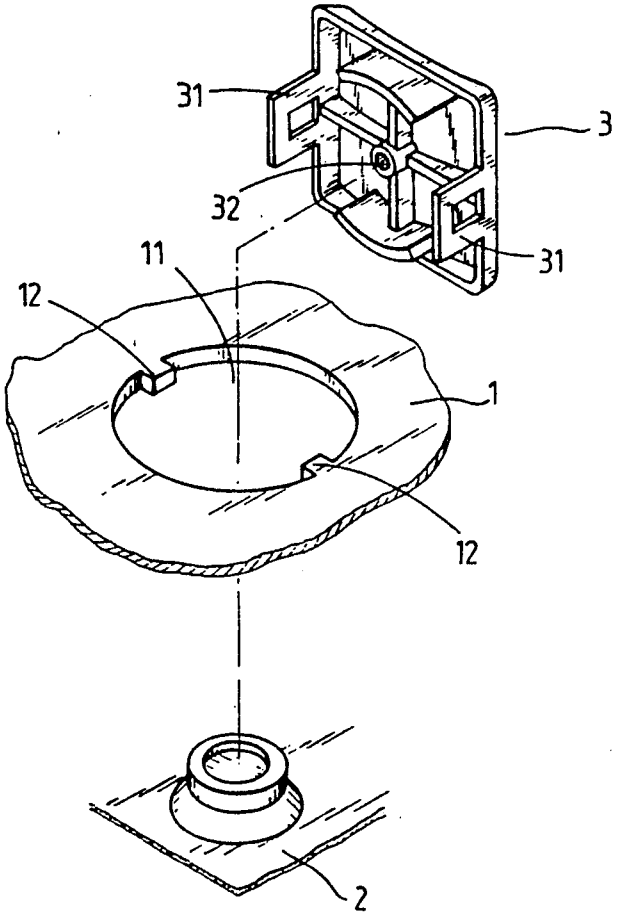
FIG. 1 (PRIOR ART)
FIG. 1 shows an exploded view of the push-button key of keyboard of prior art.

Referring to FIGS. 2 and 3, the upper housing panel 4 of the keyboard key embodied in the present invention is shown comprising a plurality of circular barrels 41 having a barrel wall 42 of a predetermined height. The barrel wall 42 comprises two slide keys 43 (second elongate slide members) which are positioned correspondingly to slide key seats 53 (first elongate slide members) of the push-button key 5. Located correspondingly to the slide key 43 is a slot 44 of an appropriate shape. Two corresponding hook lugs 45 (second hook elements) are arranged on the upper housing panel 4 at an appropriate distance from the barrel wall 42. In addition, the upper housing panel 4 comprises retreat holes 46 located under hook lugs 45.

A rubber elastic membrance 6 is composed of a plurality of elastic float capsule 61 which are embedded in the circular barrels 41.

The push-button key 5 comprises mainly a press column 51 located at the center of the bottom surface thereof, an enclosing wall 52, slide key seats 53, and fastening hooks 54 (first hook elements). The press column 51 must press against the top portion of the elastic float capsule 61 when the push-button key 5 is united with the upper housing panel 4. The enclosing wall 52 is so constructed that it embraces fittingly the barrel wall 42. The slide key seats 53 are positioned correspondingly to slide keys 43 so that they engage to help stabilize the union of the push-button key 5 and the upper housing panel 4. The fastening hooks 54 are so positioned that they engage with hook lugs 45 so as to ensure that the push-button key 5 is coupled securely with the upper housing panel 4.

As shown in FIG. 3, when the components described above are assembled, the slide keys 43 engage with slide key seats 53 to ensure that the key 5 moves accurately without deviation when it is pressed. In addition, the slot 44 is connected with the retreat hole 46 of the adjacent push-button key so as to economize the areas designated for the construction of slots 44. As a result, the keyboard can be made smaller by virtue of the fact that the push-button keys 5 are arranged at smaller interval.

It must be pointed out here that the slide keys 43, hook lugs 45 can be interchangeably constructed on the push-button key 5 rather than on the upper housing panel 4 as suggested above. On the other hand, slide key seats 53 and fastening hooks 54 can be interchangeably constructed on the upper housing panel 4 without an adverse effect on the inventive objectives intended to achieve.

Furthermore, the push-button 5 embodied in the present invention is made up of face plate 55 and bottom portion 56, which are of different colors. The bottom portion 56 is preferably made of the abrasion-resistant and self-lubricating material, such as Duracon or similar reinforced plastic. The face plate 55 comprises holes of various shapes conforming to the shapes of the designated letters or the Arabic numerals, for example 561 as shown in FIG. 3. Therefore, the letter, the word, or the numerals of the push-button keys will not become obscure or blurred after a prolonged usage of the keys by operators.

Figure 4A:
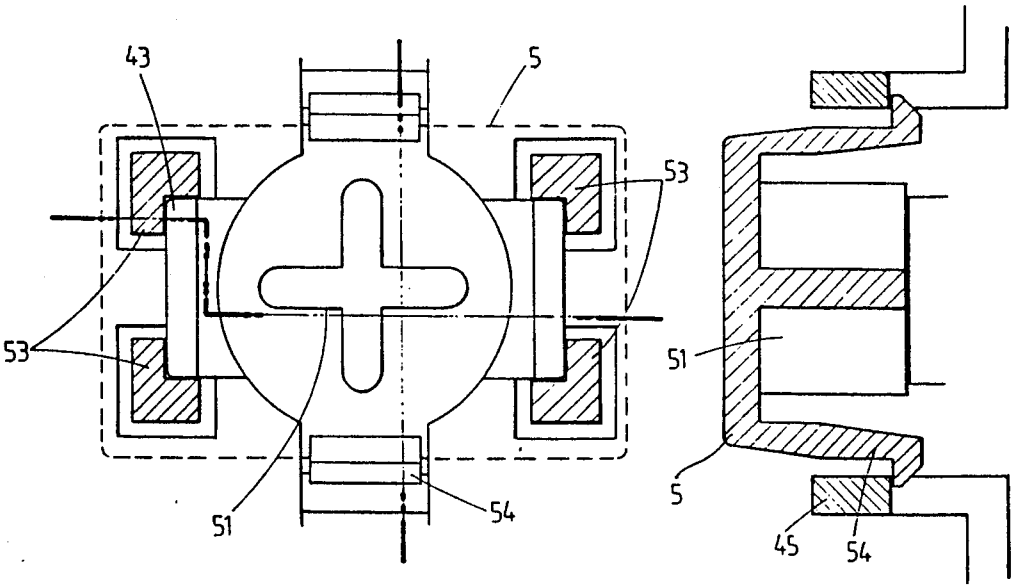
FIGS. 4*a* and 4*b* shows schematic sectional views of structures of another preferred embodiment of the present invention.
Figure 4B:
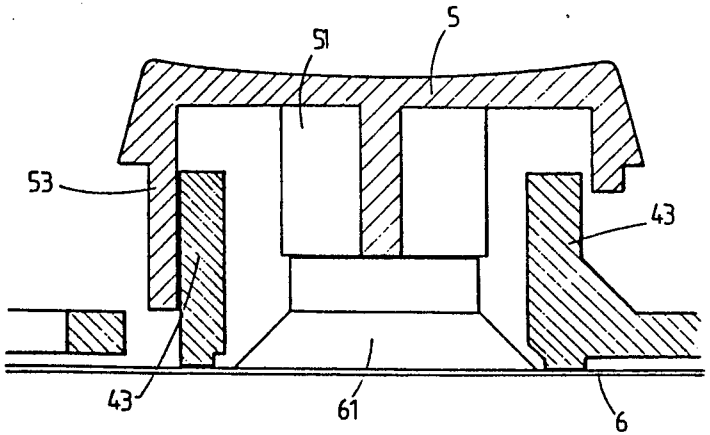

As shown in FIG. 4, another embodiment of the present invention comprises the push-button key of a rectangular shape. The slide keys 43, slide key seats 53, fastening hooks 54, and hook lugs 45 are arranged respectively at locations corresponding to the central position of each side of the push-button key 5 so as to achieve the intended objectives of the present invention.

The embodiments of the present invention described above are to be considered in all respects as merely illustrative of principles of the present invention. Accordingly, the present invention is to be limited only by the scope of the hereinafter appended claims.

What is claimed is:

1. A push-button keyboard structure comprising an upper housing panel having thereon a plurality of circular barrels each having a barrel wall of a predetermined height, and a push-button key for each barrel, each push-button key comprising a key body with a bottom surface, a press-column extending centrally from said bottom surface, and an enclosing wall extending from said bottom surface to engage over the barrel wall of a respective barrel, first elongate slide members on each enclosing wall, second elongate slide members on each barrel wall to engage with and guide the first elongate slide members, respective slots in the upper housing panel adjacent the respective second elongate slide members for receiving the first elongate slide members, first hook elements extending from the bottom surface of each key body outwardly spaced from the respective enclosing wall, second hook elements on the upper housing panel for engaging the respective first hook elements and preventing removal of the respective push-button keys, and retreat holes in the upper housing panel adjacent the respective second hook elements for receiving the respective first hook elements.

2. A structure as defined in claim 1, wherein the first elongate slide members comprise diametrically opposed female slide key seats on the respective enclosing walls and the second elongate slide members comprise correspondingly diametrically opposed male slide keys on the respective barrel walls.

3. A structure as defined in claim 1, wherein the first hook elements comprise diametrically opposed male fastening hooks on the respective push-button keys and the second hook elements comprise correspondingly diametrically opposed female hook lugs on the upper housing panel.

4. A structure as defined in claim 1, wherein the first elongate slide members comprise a pair of diametrically opposed first elongate slide members on each enclosing wall, the second elongate slide members comprise a pair of correspondingly diametrically opposed second elongate slide members on each barrel wall, the first hook elements comprise a pair of diametrically opposed first hook elements on each push-button key angularly offset from the respective slide members and the second hook elements comprise second hook elements positioned on the upper housing panel to engage the first hook elements.

5. A structure as defined in claim 4, wherein the respective slots merge with the respective retreat holes.

6. A structure as defined in claim 1, wherein each key body comprises a faceplate and a bottom portion which is of a color different to that of the faceplate and the faceplate has an opening shaped for representing a specified symbol and exposing a part of said bottom portion.

* * * * *